US010077621B2

(12) United States Patent
Gamble et al.

(10) Patent No.: US 10,077,621 B2
(45) Date of Patent: Sep. 18, 2018

(54) DIVERTER FLOW LINE INSERT PACKER SEAL

(71) Applicant: Vetco Gray Inc., Houston, TX (US)

(72) Inventors: Jamie C. Gamble, Houston, TX (US); James Reams, Houston, TX (US)

(73) Assignee: Vetco Gray, LLC, Houston, TX (US)

( * ) Notice: Subject to any disclaimer, the term of this patent is extended or adjusted under 35 U.S.C. 154(b) by 1008 days.

(21) Appl. No.: 14/303,021

(22) Filed: Jun. 12, 2014

(65) Prior Publication Data

US 2014/0367082 A1 Dec. 18, 2014

Related U.S. Application Data

(60) Provisional application No. 61/834,640, filed on Jun. 13, 2013.

(51) Int. Cl.
*E21B 33/038* (2006.01)

(52) U.S. Cl.
CPC ..... *E21B 33/038* (2013.01)

(58) Field of Classification Search
CPC ..... E21B 33/03; E21B 33/038
See application file for complete search history.

(56) References Cited

U.S. PATENT DOCUMENTS

| | | | |
|---|---|---|---|
| 2,548,412 | A | 4/1951 | Walker |
| 2,754,136 | A | 7/1956 | Phillips |
| 2,843,349 | A | 7/1958 | Meyer |
| 3,664,376 | A | 5/1972 | Watkins |
| 3,904,183 | A | 9/1975 | Allinquant et al. |
| 3,923,133 | A | 12/1975 | Chivari |
| RE29,497 | E | 12/1977 | Freitag |
| 4,174,112 | A | 11/1979 | Carrens |
| 4,358,085 | A | 11/1982 | Regan et al. |
| 4,443,017 | A | 4/1984 | Knott |
| 4,593,914 | A | 6/1986 | Johnson |
| 4,718,495 | A | 1/1988 | Lubitz et al. |

(Continued)

FOREIGN PATENT DOCUMENTS

WO 2012096755 A1 7/2012

OTHER PUBLICATIONS

International Search Report and Written Opinion issued in connection with corresponding PCT Application No. PCT/US2014/042311 dated May 12, 2015.

(Continued)

*Primary Examiner* — Nicole A Coy
*Assistant Examiner* — Kristyn A Hall
(74) *Attorney, Agent, or Firm* — Hogan Lovells US LLP

(57) ABSTRACT

A diverter for redirecting drilling fluid in oilfield applications includes a support housing and a diverter body disposed therein. A lateral opening defined in the diverter body permits fluid communication between an interior passage of the diverter body and a lateral now outlet defined by the support housing. A pair of flow-line seals disposed radially between the support housing and the diverter body includes a flow-line seal disposed on axially upper and lower sides of the lateral flow outlet. The flow-line seals include a pair of substantially rigid support rings and first and second sealing bodies adhered thereto. The first sealing body is affixed to an inner diameter wall of the first and second support rings and extends to axially upper and lower walls of the support rings. The second sealing body is bonded axially between the support rings.

18 Claims, 3 Drawing Sheets

(56) References Cited

U.S. PATENT DOCUMENTS

| | | | |
|---|---|---|---|
| 4,720,113 | A | 1/1988 | Hertz, Jr. |
| 5,094,492 | A | 3/1992 | Levivier |
| 5,167,283 | A | 12/1992 | Smith et al. |
| 5,193,616 | A | 3/1993 | Hynes |
| 5,890,535 | A | 4/1999 | Petrash et al. |
| 6,290,231 | B1 | 9/2001 | Petrash et al. |
| 6,921,090 | B2 | 7/2005 | Sun |
| 2008/0251257 | A1 | 10/2008 | Leuchtenberg |

OTHER PUBLICATIONS

PCT Search Report and Written Opinion issued in connection with corresponding Application No. PCT/US2014/042311 dated Mar. 2, 2015.

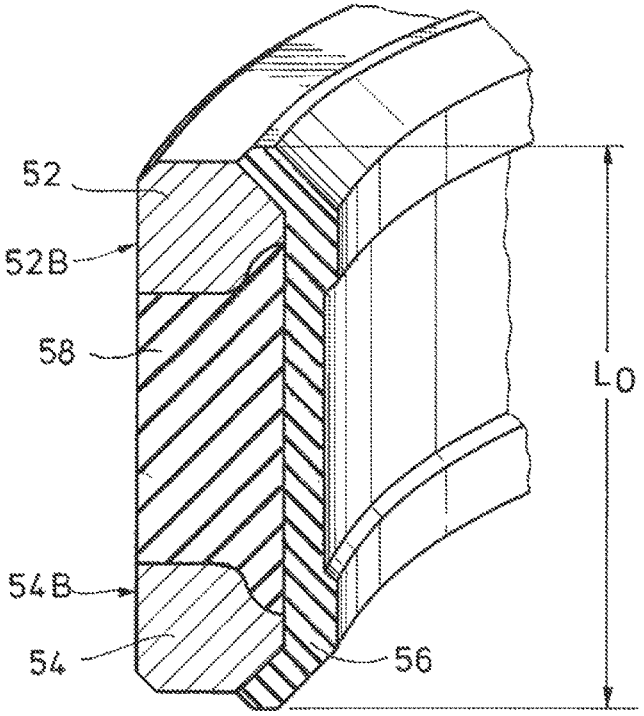
FIG. 3
FIG. 4
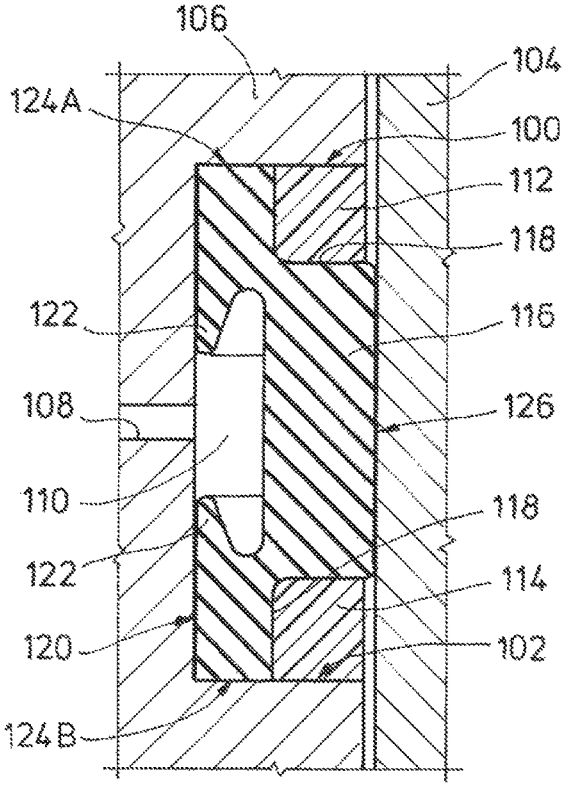
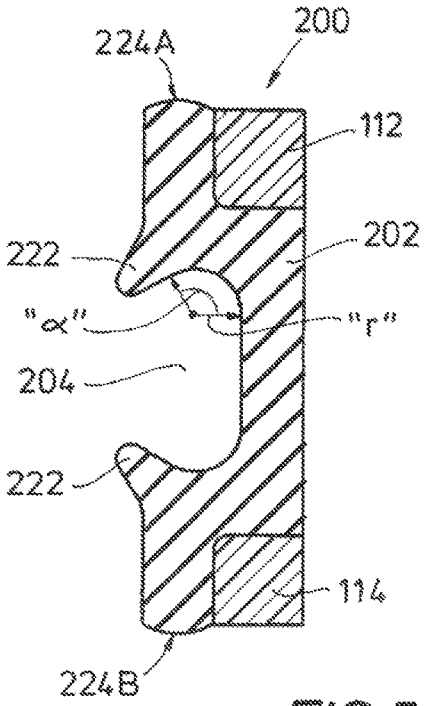
FIG. 5

DIVERTER FLOW LINE INSERT PACKER SEAL

RELATED APPLICATION

This application claims the benefit of and priority to U.S. Provisional Patent Application No. 61/834,640, titled "Diverter Flow Insert Packer Seal," filed Jun. 13, 2013, which is incorporated herein by reference in its entirety.

BACKGROUND OF THE INVENTION

1. Field of the Invention

The present invention relates in general to diverters for directing fluids in oilfield applications. More specifically, the invention relates to a diverter including flow-line seals disposed between a support housing and a diverter body positioned within the support housing.

2. Description of the Related Art

Often, diverters are mounted to offshore drilling rigs below the rig floor to redirect the flow of drilling fluid that would otherwise be blown upward to the rig floor when unbalanced wellbore pressures are encountered during initial stages of drilling. The diverters are often constructed to include a support housing, and a diverter body positioned within an axial bore of the support housing. Fluid communication is between the interior of the diverter body and a lateral flow line outlet extending from the support housing. Flow-line seals are provided between the support housing and the diverter body above and below the lateral flow line outlet.

One type of flow-line seal includes a sealing body bonded between upper and lower metal support rings. Pressurized hydraulic fluid is applied to distort an outer diameter wall of the sealing body into sealing engagement with the support housing. In some instances, the hydraulic fluid damages the bond established between the metal support rings and the sealing body.

SUMMARY OF THE INVENTION

Described herein is a flow-line seal for a diverter constructed to provide a robust bond between sealing bodies and a pair of support rings. The sealing bodies define an inner diameter wall with a recess for receiving a hydraulic fluid. The inner diameter wall extends axially between upper and lower ends of the diverter flow-line seal to isolate the bonds between the sealing bodies and the support rings from the hydraulic fluid by both primary and secondary seals.

According to one aspect of the disclosure, a diverter includes a support housing including, an axial bore and a lateral flow outlet. A diverter body is received in the axial bore of the support housing, and the diverter body includes an interior passage and a lateral opening providing fluid communication between the interior passage and the lateral flow outlet. An annular recess is defined radially between the support housing and the diverter body, and the annular recess defines an axial length. A fluid passage is in fluid communication with the annular recess, and the fluid passage is operably connectable to a source of a hydraulic activation fluid. A flow-line seal is disposed within the annular recess, and includes an upper support ring defining a radial wall and a longitudinally upper wall and a lower support ring defining a radial wall and longitudinally lower wall. The flow-line seal further includes a first elastomeric sealing body defining an annular fluid recess therein in fluid communication with the fluid passage. The first elastomeric sealing body is affixed to the radial wall of each of the upper and lower support rings and extends axially to at least the longitudinally upper wall of the upper support ring and to at least the longitudinally lower wall of the lower support ring such that the first elastomeric sealing body defines an axial length of the flow-line seal.

According to another aspect of the disclosure, a flow-line seal for establishing primary and secondary seals in an annular recess defined radially between a support housing and a diverter body of a diverter assembly includes an upper support ring, a lower support ring and first elastomeric sealing body. The upper support ring is constructed of a substantially rigid material defining an inner diameter radial wall and a longitudinally upper wall. The lower support in is constructed of a substantially rigid material defining an inner diameter radial wall and longitudinally lower wall. The first elastomeric sealing body extends across the inner diameter radial walls of the upper support ring and lower support ring such that the first elastomeric sealing body is disposed on a radially inner side of the upper and lower support rings such that the first elastomeric sealing body is operable to engage a radial facing wall of the diverter body to define the primary seal therewith. The first elastomeric sealing body also extends axially to at least the longitudinally upper wall of the upper support ring and to at least the longitudinally lower wall of the lower support ring such that the first elastomeric sealing body defines an axial length of the flow-line seal and is operable to engage longitudinally facing shoulders of the annular recess to define a secondary seal therewithin annular fluid recess is defined between two inner radial sealing surfaces of the first elastomeric sealing body along which the first elastomeric sealing body is operable to engage the diverter body to fluidly isolate the annular fluid recess from the upper and lower support rings.

BRIEF DESCRIPTION OF THE DRAWINGS

So that the manner in which the above-recited features, aspects and advantages of the invention, as well as others that will become apparent, are attained and can be understood in detail, a more particular description of the invention briefly summarized above may be had by reference to the embodiments thereof that are illustrated in the drawings that form a part of this specification, is to be noted, however, that the appended drawings illustrate only preferred embodiments of the invention and are, therefore, not to be considered limiting of the inventions scope, for the invention may admit to other equally effective embodiments.

FIG. 3 is a cross-sectional view of the flow-line seal of FIG. 2 in a relaxed or un-activated configuration.

FIG. 4 is a cross-sectional view of an alternate embodiment flow-line seal in accordance with the present invention in an activated configuration and disposed between a support housing and a diverter body.

FIG. 5 is a cross-sectional view of another alternate embodiment flow-line seal in accordance with the present invention in a relaxed or un-activated configuration.

DETAILED DESCRIPTION OF THE EXEMPLARY EMBODIMENTS

Figure 1:
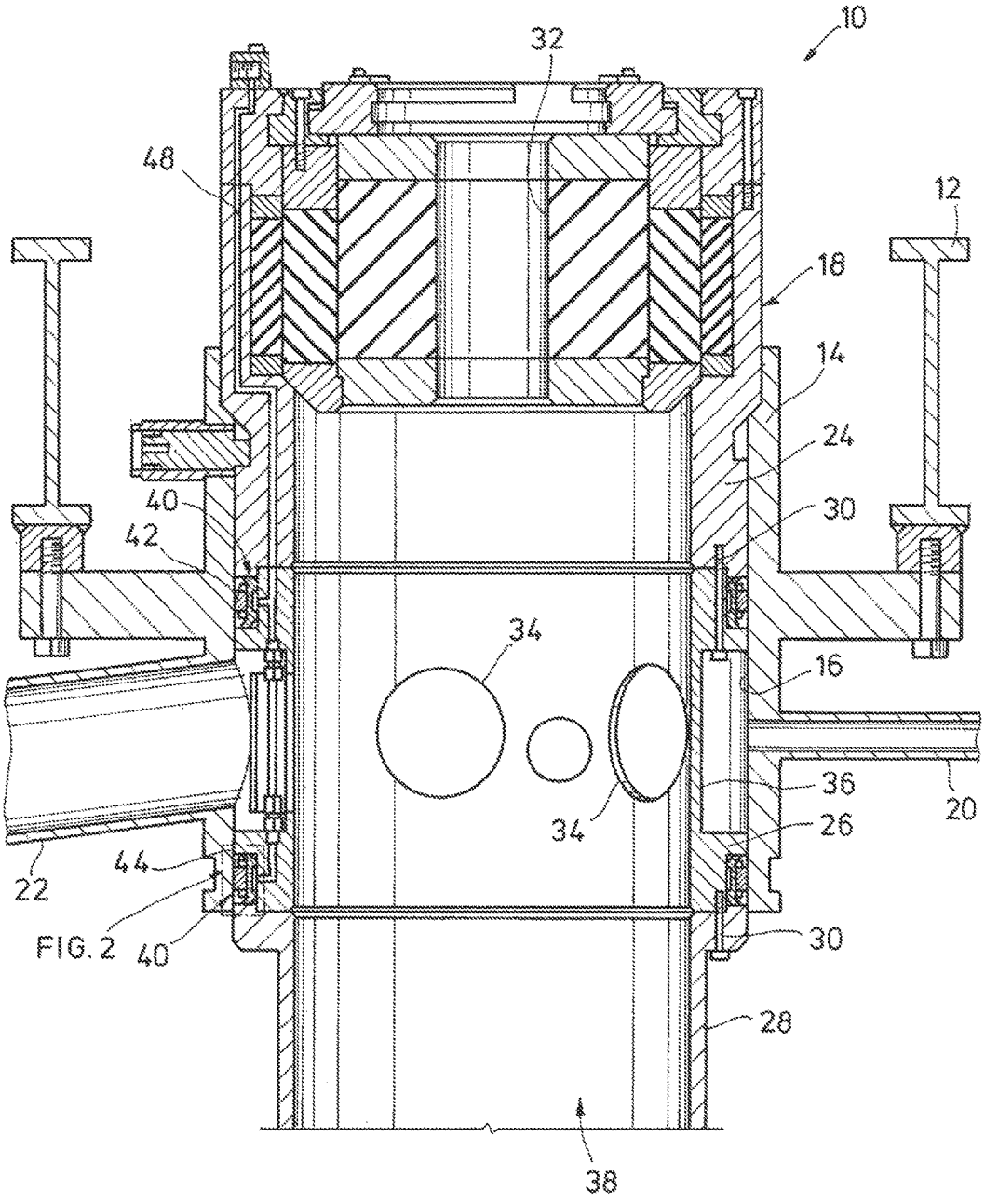
FIG. 1 is a cross-sectional view of a diverter having flow-line seals constructed in accordance with an example embodiment of the present invention disposed radially between a support housing and a diverter.

Referring generally to FIG. 1, a diverter 10 is provided with mourning brackets 12 for securing the diverter 10 to a drilling rig (not shown) below the rig floor. The diverter 10 includes a support housing 14 defining an axial bore 16, and a body 18 disposed within the axial bore 16. The support housing 14 includes a first lateral flow line 20 for accommodating a normal return flow of drilling fluid, and a second lateral flow line 22 for selectively venting drilling fluid, e.g., in the event unbalanced wellbore pressures are encountered during initial stages of drilling. The diverter body 18 includes an upper portion 24, a central portion 26 and a lower portion 28, which are secured to one another with bolts 30. The upper portion 24 supports an annular main packer seal 32 therein for sealing around a drill string (not shown) received axially within the diverter 10. Central portion 26 has lateral flow openings 34 that are axially aligned with the first and second lateral flow lines 20, 22. A circumferential recess 36 is located on the outer diameter of central portion 26 to communicate a flow of drilling fluid from lateral flow openings 34 to the first and second lateral flow lines 20, 22. Drilling fluid returning up hole in an annular region surrounding the drill string (not shown) flows from an interior axial passage 38 of the diverter body 18, through the lateral flow openings 34, into the circumferential recess 36, and into at least one of first and second lateral flow lines 20, 22.

A pair of identical flow-line seals 40 are disposed axially above and below the first and second flow line 20, 22 in a respective annular recesses 42, 44 defined by the diverter body 18. A fluid passage 48 is in fluid communication with both of the annular recesses 42, 44 and provides a flow path for a pressurized hydraulic activation fluid (not shown) to energize the flow-line seals 40. The flow-line seals 40 are located radially between the support housing 14 and the central portion 25 of the diverter body 18, and serve to prevent fluid from leaking about the central portion 25 of the diverter body 18.

Figure 2:
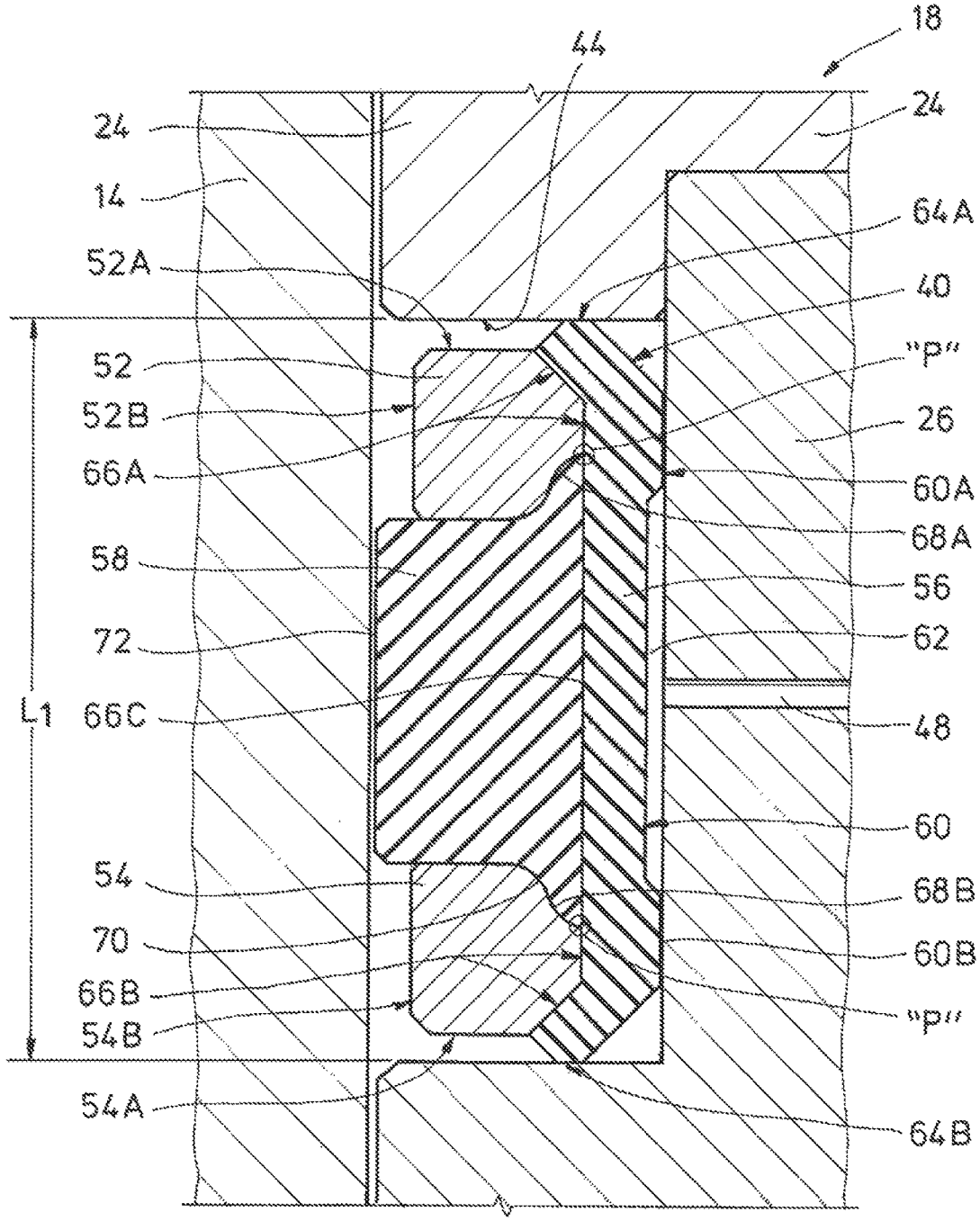
FIG. 2 is an enlarged cross sectional view of the area of interest identified in FIG. 1 illustrating one of the flow-line seals in an activated configuration wherein the flow-line seal is distorted by hydraulic pressure into sealing engagement with the support housing.

Referring now to FIG. 2, a lower one of the flow-line seals 40 is illustrated in an activated configuration within the annular recess 44. The flow-line seal 40 comprises upper and lower support rings 52, 54, and first and second elastomeric sealing bodies 56, 58 affixed thereto. The support rings 52, 54 are substantially rigid and stabilize the shape sealing bodies 56, 58 during molding and other manufacturing processes used to create the flow-line seals 40. In some embodiments, the support rings 52, 54 are constructed of steel or another metallic material, in other embodiments, the support rings 52, 54, or, e.g., the support rings 112, 114 described below with reference to FIGS. 4 and 5, are constructed from hardened polymer materials, carbon fiber reinforced resins or other composite materials, which offer high strength and rigidity at a relatively low weight. In some instances, carbon fiber reinforced materials offer improved adhesive adherence characteristics over metallic materials.

In some embodiments, the first, and second sealing bodies 56, 58 are constructed of dissimilar elastomeric materials such that the first sealing body 56 is constructed of a relatively soft material with respect to the second sealing body 58. For example, in the embodiment described herein with reference to FIG. 2, the first sealing body 56 is constructed of a nitrile rubber material having a hardness in the range of about 55 to about 80 durometer, and the second sealing body 58 is constructed of a nitrile rubber material having a hardness in the range of about 70 to about 95 durometer. In other embodiments, the first and second sealing bodies 56, 58 are constructed of similar elastomers.

The first sealing body 56 defines an inner diameter wall 60, which includes two inner radial sealing surfaces 60A, 60B along which the inner diameter wall 60 engages the central portion 26 of the diverter body 18. The inner surfaces 60A, 60B are axially elongated, and are generally flat in cross section. An annular fluid recess 62 is defined axially between the two inner radial surfaces 60A, 60B such that the annular fluid recess 62 is in fluid communication with fluid passage 48. The inner diameter wall 60 of the first sealing body 56 extends axially between upper and lower end surfaces 64A, 64B of the first sealing body 56. The upper surface 64A engages a downward-facing shoulder of the upper portion 24 of the diverter body 18, and the lower end surface 64B engages an upward-facing shoulder of the central portion 26 of the diverter body 18. In the example embodiment depicted in FIG. 2, the first sealing body 56 extends axially beyond the support rings 52, 54, i.e., above an axially upper wall 52A of the upper support ring 52 and axially below an axially lower wall 54A of the lower support ring 54. In other embodiments (not shown) a first sealing body is axially coextensive with a pair of support rings such that the upper and lower end surfaces of the first sealing body are generally flush with the support rings 52, 54. As depicted in FIG. 2, the first sealing body 56 is adhered to support rings 52, 54 along interfaces 66A, 66B by an adhesive or similar bond. An interface 66C, established between the first and second sealing bodies 56, 58 is substantially free of adhesive or any bond such that the interface 66C is flexible.

The second sealing body 58 is sandwiched axially between the support rings 52, 54. Symmetrical non-rectilinear interfaces 68A and 68B are established between the second seating body 58 and the support rings 52, 54. The non-rectilinear interfaces 68A, 68B are S-shaped in cross-section to form shoulders 70 with inwardly-facing rounded corners. The second seating body 58 is bonded to the support rings 52, 54 along the non-rectilinear interfaces 68A, 68B. In some embodiments, the second sealing body 58 is bonded to the support rings 52, 54 along the non-rectilinear interfaces 68A, 68B with an adhesive during a molding process. In other embodiments, an adhesive bond is established along the non-rectilinear interfaces 68A, 68B subsequent to molding the second sealing body 58. In some embodiments, the first sealing body 56 is applied to the to support rings 52, 54 along interfaces 66A, 66B subsequent to establishing the bond between the second sealing body 58 and the support rings 52, 54 such that inner-most points "P" of the non-rectilinear interfaces 68A, 68B are covered by the first sealing body 50. In some embodiments, the first sealing body 56 is bonded only to the support rings 52, 54, such that the first sealing body 56 is substantially unadhered to the second sealing body 58, e.g., along interface 66C.

An outer diameter surface 72 of the second sealing body 58 is disposed radially outward from outer diameter walls 52B, 54B of the support rings 52, 54 when the flow-line seal 40 is in the activated configuration. The outer diameter surface 72 engages the support housing 14 to prevent leakage of fluids between the support housing 14 and the diverter body 18.

In one example embodiment, of use, as described with reference to FIGS. 2 and 3, a flow-line seal 40 is initially provided in a relaxed or un-activated configuration (FIG. 3). In the un-activated configuration, the first sealing body 56 exhibits an initial axial length $L_O$, and the second sealing body 58 is generally flush with the outer diameter walls 52B, 54B of the support rings 52, 54. The flow-line seal 40 is then positioned within the annular recess 44 (FIG. 2). The annular recess 44 exhibits an axial length $L_1$ between longitudinally facing shoulders that is smaller than the initial axial length L of the first sealing body 56. Thus, the flow-line seal 40 is axially compressed when positioned within the annular recess 44. The axial compression of the flow-line seal 40 establishes primary seals between the inner surfaces 60A, 60B of the first sealing body 56 and the diverter body 18, and also energizes secondary seals established between the upper and lower end surfaces 64A, 64B of the first sealing body 56 and the diverter body 18.

Once the flow-line seal 40 is in position within the annular recess 44, a hydraulic activation fluid (not shown) is introduced to the annular fluid recess 62 through fluid passage 48. Introduction of the hydraulic activation fluid pressurizes the annular fluid recess 62, thereby exerting a radially outward force on a central portion of the first scaling body 56 to distort the shape of the first sealing body 56. The central portion of the first scaling body 56 is thereby induced to exert a radially outward force on the second sealing body 58 to distort the shape of the second sealing body 58 such that the outer diameter surface 72 engages the support housing 14.

Since the first sealing body 56 extends axially across the entire annular recess 44, the symmetrical non-rectilinear interfaces 68A and 68B are fully isolated from the annular pressurized annular fluid recess 62. The innermost points "P" along the non-rectilinear interfaces 68A and 68B are disposed on a radially opposite side of the first scaling body 56 from the hydraulic fluid, and also axially spaced from the upper and lower end surfaces of the first sealing body 56. Thus, the first sealing body 56 is arranged to isolate the non-rectilinear interfaces 68A, 68B from the hydraulic fluid. The relatively soft first sealing body 56 maintains the primary seals (along the two inner surfaces 60A, 60B) even in the event the central portion 26 of the diverter body 18 is damaged and/or corroded.

Referring now to FIG. 4, an alternate embodiment of a fluid line seal 100 is illustrated in an activated configuration. The fluid line seat 100 is disposed in an annular recess 102 defined radially between a support housing 104 and a diverter body 106. The diverter body 106 includes a fluid passage 108 through which a hydraulic activation fluid is passable to be introduced into an annular recess 110.

The fluid line seal 100 includes upper and lower support rings 112, 114 and a scaling body 116 bonded therebetween along symmetrical interfaces 118. The support rings 112, 114 are relatively rigid with respect to the flexibility of the sealing body 116. In some embodiments, the support rings 112, 114 are constructed of a carbon fiber material, or another composite material, and the sealing body 116 is constructed of a nitrile rubber or another elastomeric material. An inner diameter wall 120 of the sealing body 116 includes a pair of flexible annular lips 122. Lips 122 protrude axially toward one another and abut the diverter body 106 to form a pair of primary seals therewith. The inner diameter wall 120 extends axially between upper and lower ends surfaces 124A, 124B of sealing body 116. The upper and tower ends surfaces 124A, 124B engage the diverter body 106 and establish secondary seals therewith.

The symmetrical interfaces 118 are fluidly isolated from annular fluid recess 110 by both the primary and secondary seals established by the elastomeric sealing body 116. Introduction of a hydraulic activation fluid pressurizes the annular fluid recess 110, thereby providing a radially inward force to the lips 120 and facilitating maintenance of the engagement between the lips 122 and the diverter 106. A radially outward force is also applied to an outer wall 126 of the sealing body 116, such that outer wall 126 engages the support housing 104 and establishes a seal therewith.

Referring now to FIG. 5, an alternate embodiment of a fluid line seal 200 is illustrated in a relaxed or un-activated configuration. The fluid line seal 200 is substantially similar to fluid line, seal 100 except that an elastomeric sealing body 202 defines an annular fluid recess 204 having a different shape than the annular fluid recess 110. The sealing body 202 includes walls 125 having a radius "r" extending to lips 222. The radius "r" extends over an angle "α," which in some embodiments is greater than about 165 degrees. The extension of radius "r" over a relatively large range promotes flexibility of the elastomeric sealing body 202, and thus allows for robust primary seals to be formed with the lips 222, and robust secondary seals to be formed along upper and lower end surfaces 224A, 224B. As illustrated in FIG. 5, the upper and lower end surfaces 224A, 224B bulge axially beyond the upper and lower support rings 112, 114 when a fluid line seal 200 is in the relaxed or on-activated configuration. Thus, the upper and lower end surfaces 224A, 224B define axially upper-most and axially lower-most surfaces of the fluid line seal 200.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. These and other similar modifications will readily suggest themselves to those skilled in the art, and are intended to be encompassed within the spirit of the present invention disclosed herein and the scope of the appended claims.

What is claimed is:

1. A diverter comprising:

a support housing including an axial bore and a lateral flow outlet;

a diverter body received in the axial bore of the support housing, the diverter body including an interior passage and a lateral opening providing fluid communication between the interior passage and the lateral flow outlet;

an annular recess defined radially between the support housing and the diverter body, the annular recess defining an axial length;

a fluid passage in fluid communication with the annular recess, the fluid passage operably connectable to a source of a hydraulic activation fluid; and a flow-line seal disposed within the annular recess, the flow-line seal comprising:

an upper support ring defining a radial wall and a longitudinally upper wall;

a lower support ring defining a radial wall and longitudinally lower wall; and a first elastomeric sealing body defining an annular fluid recess therein in fluid communication with the fluid passage, the first elastomeric sealing body affixed to the radial wall of each of the upper and lower support rings and extending axially to at least the longitudinally upper wall of the upper support ring and to at least the longitudinally lower wall of the lower support ring such that the first elastomeric sealing body is in direct contact with a downward-facing shoulder of the diverter body and an upward-facing shoulder of the diverter body.

2. The diverter according to claim 1, wherein the annular fluid recess is defined axially between a pair of radial sealing surfaces of the first elastomeric sealing body along which the first elastomeric sealing body engages a radially facing wall of one of the support housing and the diverter body to define a primary seal therewith, and wherein upper and lower end surfaces of the first elastomeric sealing body engage longitudinally facing shoulders of the annular recess to define a secondary seal therewith, and wherein the primary and secondary seals fluidly isolate the annular fluid recess from the upper and lower support rings.

3. The diverter according to claim 2, wherein the first elastomeric sealing body in a relaxed state defines an initial axial length of the flow-line seal between the upper and lower end surfaces, and wherein the initial axial length of the flow-line seal is greater than the axial length of the annular recess such that the first elastomeric sealing body is axially compressed within the annular recess.

4. The diverter according to claim 2, wherein the radial sealing surfaces are defined on flexible annular lips protruding axially toward one another and operable to impart a radial force on the radially facing wall of the one of the support housing and the diverter body.

5. The diverter according to claim 1, further comprising a second elastomeric sealing body disposed longitudinally between the upper and lower support rings, the second elastomeric sealing body bonded to a longitudinally lower wall of the upper support ring and bonded to a longitudinally upper wall of lower support ring.

6. The diverter according to claim 5, wherein the second elastomeric sealing body is bonded along S-shaped interfaces to the upper and lower support rings.

7. The diverter according to claim 5, wherein the first elastomeric sealing body is constructed of a relatively soft material with respect to the second elastomeric sealing body.

8. The diverter according to claim 5, wherein an interface established between the first elastomeric sealing body and the second elastomeric sealing body is devoid of adhesive or bond.

9. The diverter according to claim 5, wherein the first elastomeric sealing body engages a radially facing wall of one of the support housing and the diverter body and wherein the second elastomeric sealing body engages a radially facing wall of the other of the support housing and diverter body when activated by introduction of a pressurized fluid into the annular fluid recess.

10. The diverter according to claim 1, wherein the upper support ring and the lower support ring are constructed of a carbon fiber reinforced resin.

11. A flow-line seal for establishing primary and secondary seals in an annular recess defined radially between a support housing and a diverter body of a diverter assembly, the flow-line seal comprising:

an upper support ring constructed of a rigid material defining an inner diameter radial wall and a longitudinally upper wall;

a lower support ring constructed of a rigid material defining an inner diameter radial wall and longitudinally lower wall;

a first elastomeric sealing body extending across the inner diameter radial walls of the upper support ring and lower support ring such that the first elastomeric sealing body is disposed on a radially inner side of the upper and lower support rings such that the first elastomeric sealing body is operable to engage a radial facing wall of the diverter body to define the primary seal, and wherein the first elastomeric sealing body extends axially to at least the longitudinally upper wall of the upper support ring and to at least the longitudinally lower wall of the lower support ring such that the first elastomeric sealing body defines an axial length of the flow-line seal and is operable to engage a downward-facing shoulder and an upward-facing shoulder of the diverter body to define a secondary seal therewith; and an annular fluid recess defined between two inner radial sealing surfaces of the first elastomeric sealing body along which the first elastomeric sealing body is operable to directly engage a latitudinal-facing surface of the diverter body to fluidly isolate the annular fluid recess from the upper and lower support rings.

12. The flow-line seal according to claim 11, wherein the first elastomeric sealing body extends between the upper and lower support rings to outer diameter walls of the support rings such that the first elastomeric sealing body is operable to engage the support housing.

13. The flow-line seal according to claim 11, wherein a second elastomeric sealing body extends between the upper and lower support rings to outer diameter walls of the support rings such that the second elastomeric sealing body is operable to engage the support housing, and wherein the first and second elastomeric sealing bodies are constructed of different elastomers.

14. The flow-line seal according to claim 13, wherein the first and second elastomeric sealing bodies are each bonded to the upper and lower support rings, and wherein the first and second elastomeric sealing bodies engage one another along an interface where the first and second sealing bodies are unadhered to one another.

15. The flow-line seal according to claim 13, wherein the second elastomeric sealing body is bonded to the upper and lower support rings along s-shaped interfaces having shoulders with inwardly-facing rounded corners.

16. The flow-line seal according to claim 11, wherein the two inner radial sealing surfaces on the first elastomeric sealing body are defined on pair of flexible lips, and wherein the fluid recess includes walls having a radius extending to the flexible lips.

17. The flow-line seal according to claim 16, wherein the radius extends over an angle that is greater than about 165 degrees.

18. The flow-line seal according to claim 11, wherein the upper and lower support rings are constructed from a material including at least one of the following: a metal material; a polymer material; and carbon fiber reinforced resin.

* * * * *